United States Patent [19]

Frohlich et al.

[11] 4,181,159

[45] Jan. 1, 1980

[54] METHOD OF AND APPARATUS FOR MAKING A SLIDE-FASTENER STRINGER

[75] Inventors: Alfons Frohlich, Essen; Horst Ranalli, Wintersberg-Niedersfeld, both of Fed. Rep. of Germany

[73] Assignee: OPTI Patent-, Forschungs- und Fabrikations-AG, Glarus, Switzerland

[21] Appl. No.: 880,365

[22] Filed: Feb. 23, 1978

[30] Foreign Application Priority Data

Feb. 24, 1977 [DE] Fed. Rep. of Germany ..... 2707946

[51] Int. Cl.[2] ..... D03D 47/00; D03D 47/02; D03D 47/42

[52] U.S. Cl. ..... 139/116; 139/384 B; 139/431; 139/442

[58] Field of Search ..... 139/116, 11, 440–442, 139/431, 384 B

[56] References Cited

U.S. PATENT DOCUMENTS

| | | | |
|---|---|---|---|
| 3,692,068 | 9/1972 | Auer et al. | 139/116 |
| 3,765,457 | 10/1973 | Glindmeyer et al. | 139/116 X |
| 3,847,188 | 11/1974 | Auer et al. | 139/384 B |
| 3,871,420 | 3/1975 | Jakob | 139/116 |
| 4,078,585 | 3/1978 | Frohlich | 139/384 B |

*Primary Examiner*—James Kee Chi

*Attorney, Agent, or Firm*—Karl F. Ross

[57] ABSTRACT

A slide-fastener stringer is formed by weaving a weft in a warp and simultaneously forming a continuous coupling element along each of the confronting edges of a pair of tapes simultaneously produced by the weaving operation. The synthetic-resin monofilament forming the coupling element is passed around a mandrel between the warp stretches so that the heads of the two coupling elements are produced in interdigitated form. The ground weft yarn is carried from the coupling element side of each set of warps through the shed to the opposite edge of the tape where it is locked into other loops of previous passes of weft by knitting.

8 Claims, 5 Drawing Figures

IV

METHOD OF AND APPARATUS FOR MAKING A SLIDE-FASTENER STRINGER

CROSS REFERENCE TO RELATED APPLICATIONS

This application is related to the commonly assigned copending application Ser. No. 722 265 filed Sept. 10, 1976 (U.S. Pat. No. 4,098,299 issued July 4, 1978) by Alfons FRÖHLICH (one of the present joint inventors) and to its continuation-in-part application Ser. No. 831 994 filed Sept. 9, 1977. It also relates to application Ser. No. 722 339 filed Sept. 10, 1976 (U.S. Pat. No. 4,078,585 issued Mar. 14, 1978) by Alfons FRÖHLICH, to its division Ser. No. 755 592 filed Dec. 30, 1976, (U.S. Pat. No. 4,127,147) and to application Ser. No. 722 048 of Sept. 10, 1976 (U.S. Pat. No. 4,099,302 issued July 11, 1978) filed by Alfons FRÖHLICH jointly with Walter PASSMANN).

FIELD OF THE INVENTION

The present invention relates to a method of making a slide fastener having a woven support tape and to an apparatus for carrying out this method. More particularly, the invention relates to a method of and to an apparatus for the weaving of a slide-fastener stringer integrally with the coupling elements thereof.

BACKGROUND OF THE INVENTION

In the slide-fastener art it is known to provide a respective coupling element along each edge of a woven support or carrier tape so that the row of coupling heads of each coupling element may be interdigitated with the opposing row upon the movement of a slider along these rows. The movement of the slider in the opposite direction being effective to decouple the heads of the two rows.

While a number of techniques have been proposed for mounting the coupling element upon the support tape, including the stitching of the coupling element to the support tape between the turns of the coupling element using chain stitching with or without a filler cord or fillet which passes through the turns, insertion of a preformed coupling element through spaces left in or formed in the tape, and wrapping a portion of the tape around part of the coupling element with or without a filler cord, it has been increasingly of interest in recent years to form the coupling element simultaneously with the tape-making operation and thereby making the coupling element an integral part of the tape.

Techniques for carrying out the last-mentioned operation are described in the afore-mentioned copending applications.

In the present description, certain terminology will be used which may warrant brief discussion before the state of the art and the invention are delved into more deeply. A slide-fastener stringer is generally composed of two slide-fastener halves each of which consists of a support tape and a coupling element along an edge of the tape interengageable with the coupling element of the other slide-fastener half.

To form the slide-fastener stringer into a complete slide fastener, it is customary to mount upon the coupling edges of the stringer, a slider which may be moved to and fro longitudinally of the stringer, i.e., along the axis thereof.

In addition, end stop members may be formed at the end of one or each coupling element for a length of stringer and these end step members may be separable or can hold the two stringer halves together depending upon whether the slide fastener is of the separable type or not.

The coupling element itself, for the present purposes, will be referred to as a continuous synthetic-resin monofilament provided with a number of turns each of which defines a head which can have projections along the axis engageable behind the projections of a pair of heads of the opposing coupling element when the coupling heads of the two elements are interdigitated, i.e., when a head of one coupling element is received in the space between a pair of heads of the opposing elements.

Each head and shanks which extend away from the head can be referred to as a coupling member and thus each coupling element consists of a row of closely and uniformly spaced coupling members joined together remote from the head by bights of the monofilament which connect one shank of each coupling member with a shank of the next coupling member.

Conventional weaving terminology will apply in describing the woven portion of the tape or stringer. For example, the tape may be made up of a warp or group of warp threads extending longitudinally and generally parallel to the axis of the stringer and by a weft which can be passed through the warp threads, e.g., by a weft needle when the tape loom is of the shuttleless type.

As will be apparent from the aforementioned coupling applications, the principal technique in the weaving of a coupling element into a support tape to form a slide-fastener stringer requires two groups of warp threads or yarns which are shedded by heddles in the usual manner, the coupling elements being formed as a synthetic-resin monofilament strand which is carried by a respective needle across a mandrel disposed between the warp groups so that, upon return of the needle, the monofilament is bent around this mandrel to form a coupling head. The shanks of the coupling member will thus lie directly within a warp shed and the reshedding of the warp weaves the coupling element into the tape as the entire weft, as a portion of the weft or over a limited number of warp yarns as required.

Naturally, as the coupling elements are carried across the warp and around the mandrel from opposite sides, two such coupling elements are formed in interdigitated relation along the mandrel.

When the synthetic-resin monofilament is not to constitute the sole weft of the tape, a double-needle arrangement is provided to carry a further weft yarn across all or portions of the warp. The additional weft yarn may be looped into the bight or otherwise passed around portions of the coupling element to afford additional anchorage of the latter. The mandrel is mounted in an upwardly and downwardly movable holder between the groups of warp yarns adapted to form each of the tapes and both the coupling element and the additional weft yarn are supplied to the respective needle at the outer sides of the warp.

In practice, while this has been found to be highly effective in providing a pair of slide-fastener halves in a coupling state using weaving techniques, the speed with which the system can operate has been found to be limited, especially when very high quality stringers are to be made.

OBJECTS OF THE INVENTION

It is the object of the present invention to improve upon the techniques and apparatus described in the aforementioned copending applications and, in general, to increase the speed with which slide-fastener stringers can be fabricated while retaining high quality.

It is another object of the invention to provide an improved method of making a slide-fastener stringer of high quality, i.e., fine gauge and reliability, with a high degree of flexibility and separation resistance.

It is another object of the invention to provide an improved method of fabricating slide-fastener stringers so that the rate at which the same can be produced on a tape loom can be increased, e.g., by comparison with earlier methods in which the coupling element is woven into and formed as part of the tape.

Still another object of this invention is to provide an improved apparatus for manufacturing a slide-fastener stringer.

SUMMARY OF THE INVENTION

According to the invention, a slide-fastener stringer is formed by disposing two groups of warp threads or yarns on opposite sides of a mandrel about which the coupling heads of the coupling elements are to be formed in an interdigitated manner.

The warp is shedded in the usual manner and the weft threads of yarns adapted to form part of the ground fabric, i.e., the weft threads or yarns to be passed through the sheds in addition to the introduction of the coupling element monofilaments, is fed to the shed between the two groups of warp yarn or, at any rate, along the side of the warp at which the respective coupling element is to be found in the weaving direction.

The ground weft yarn for each group of warp threads (i.e., for each stringer half) is then carried through the respective shed and locked into a previous pass of the weft by knit looping. In other words, instead of carrying the weft into each warp shed of the respective slide-fastener half from an outer edge thereof, the ground weft threads are carried from a central region through the shed toward the outer edge of the slide-fastener half and each such weft is looped into a previous pass of the weft by a knitting operation.

In this method, moreover, the weft yarns can be set within each shed by a needle which engages the weft and entrains it into the respective shed but is connected with a needle adapted to form the coupling element in the manner described in the aforementioned copending applications. Here, however, the weft-carrying needle is not provided with an eye engaging the weft in both directions, but only with a notch enabling it to pick up the weft after it has traveled across the other group of warp yarns.

In the system, of the present invention, therefore, the weft yarns are not, unlike those of some earlier systems entrained across the full width of the warp, i.e., both groups or sets of warp threads. They are, on the contrary, fed to the knitting location approximately at a central region between the outer edges of the groups of warps and are picked up by the free ends of the respective weft needle as they complete their travel, unloaded across one set of the warp threads, the needles entraining the weft yarn across the other set of warp yarn. Along the outer edge of this latter set of warp yarns, a hooking element is provided, e.g., a latch needle or shroud needle, to engage the newly formed loop of weft and pass the previously formed loop over it.

It is thus an important feature of the present invention that the ground weft yarn is not carried from an outer edge of the warp through the shed, but rather is entrained from an inner edge or side of the warp, outwardly. The apparatus must thus make use of a yarn-engaging notch to pick up the ground weft, rather than a needle eye.

According to a feature of the invention, the ground weft needle, with its notch as described, is connected with the needle for introducing into the warp, the synthetic-resin monofilament which is to form the coupling elements of the respective stringer half. In this case, weft filament or thread need not be hooked around the synthetic-resin monofilament but can be woven into the warp along a marginal portion thereof, i.e., at least two warp yarns lying closer to the coupling edge of the tape than the bights so that this edge can be a full woven edge. In other words, the arrangement of the present invention makes it possible, with a system in which the coupling element is interwoven and formed in situ in the manner described, to also provide fully woven edges not only along the outer edges. These additional woven coupling edges play a role of filler cords for securing the respective coupling elements in place.

An important feature of the invention is that the woven inner or coupling edge of the tape has a symmetry about the slide-fastener plane, i.e., the plane of the tape, so that eccentric stresses do not arise. This makes the slide-fastener stringer more resistant to separation, more flexible and more free from a tendency to kink or break.

Naturally, because the weave structure along the coupling edge of the tape also lies between the coupling heads of the respective coupling element, it functions as a filler for this space, especially where the weft bends around to form a return pass. This has been found to stabilize the spacing of the coupling members and maintain a uniform gauge. The result is an especially high quality slide fastener which is reliable and can be produced at extremely high speeds in spite of the fact that a knitting operation to lock the weft is carried out along the outer edge of each stringer half. This is because, inter alia, the weft thread lifters hitherto required are eliminated and the tension of the weft is reduced.

It has been found advantageous to form the outer and inner warp threads, which are used to lock the coupling element in place, with one type of weave pattern while the intervening warp threads are formed in a different pattern. More particularly, the inner and outer warp threads along the coupling edge are preferably reshedded after each pass of the weft thread while the intervening warp threads are reshedded after each second pass of the warp thread. The result is a 1/1 pattern for the inner and outer warp threads and a 2/2 pattern for the intervening warp threads. The 1/1 pattern prevails directly adjacent the coupling heads and the bights between coupling members.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
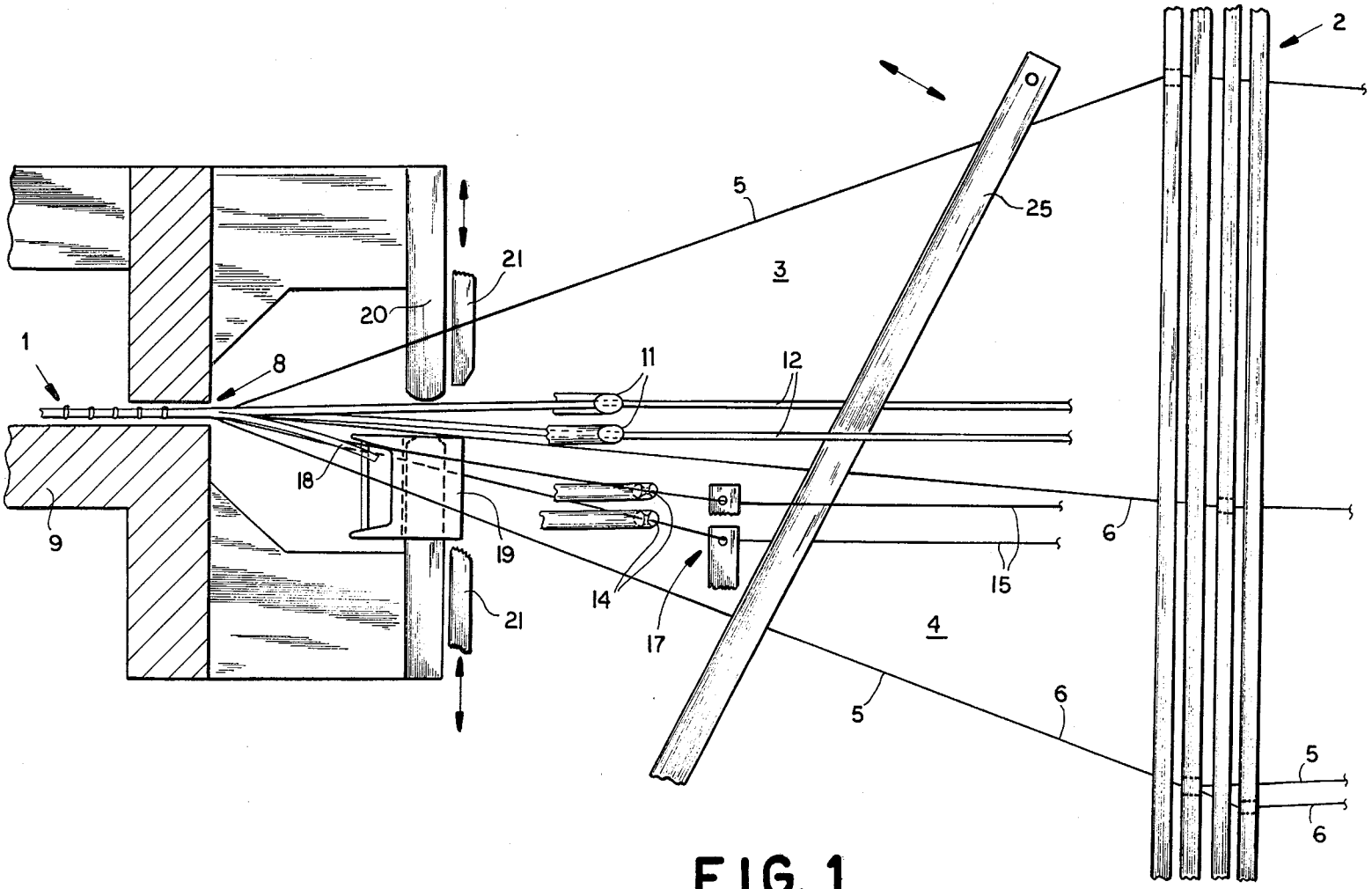
FIG. 1 is a diagrammatic side-elevational view of a loom for making a slide fastener in accordance with the improved process of the present invention.
Figures 2, 4A, 4B:
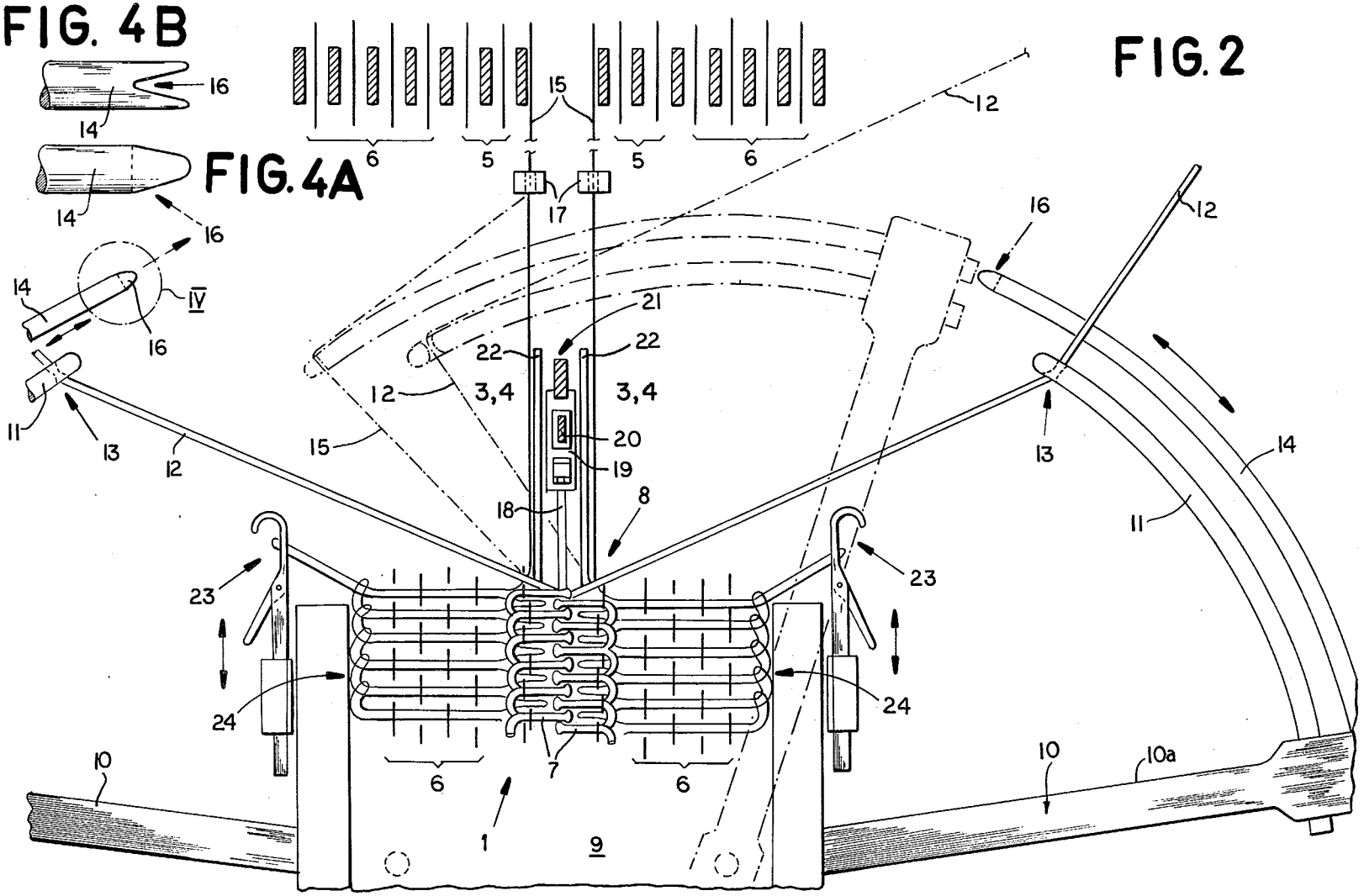
FIG. 2 is a diagrammatic plan view of the weaving portion of the loom.
FIGS. 4A and 4B are detail views, drawn to an enlarged scale, of the tip of the weft-yarn pickup needle corresponding to the portion IV of FIG. 2.

The loom of FIGS. 1 and 2 is basically a tape loom using a needle system for insertion of the weft, i.e., a shuttleless automatic needle loom. It comprises a mechanism 2 for feeding the warp, this mechanism being illustrated diagrammatically in FIGS. 1 and 2 and consisting of the usual array of heddle frames (four in number) with respective heddles through which the warp yarns 5 and 6 pass. The reed for beating up the weft is shown at 25. The stringer emerges as shown at 1.

The heddle system 2 is adapted to form the shed 3 and the further warp shed 4 from the warp yarns 5 and 6.

The shed 3 is provided for the inner group of warp yarns 5 of each warp set for a coupling half to lock the coupling element 7 in place and fill the interstices between the coupling heads. These warp yarns 5 alternate between a high-shed and low-shed position.

Figure 3:
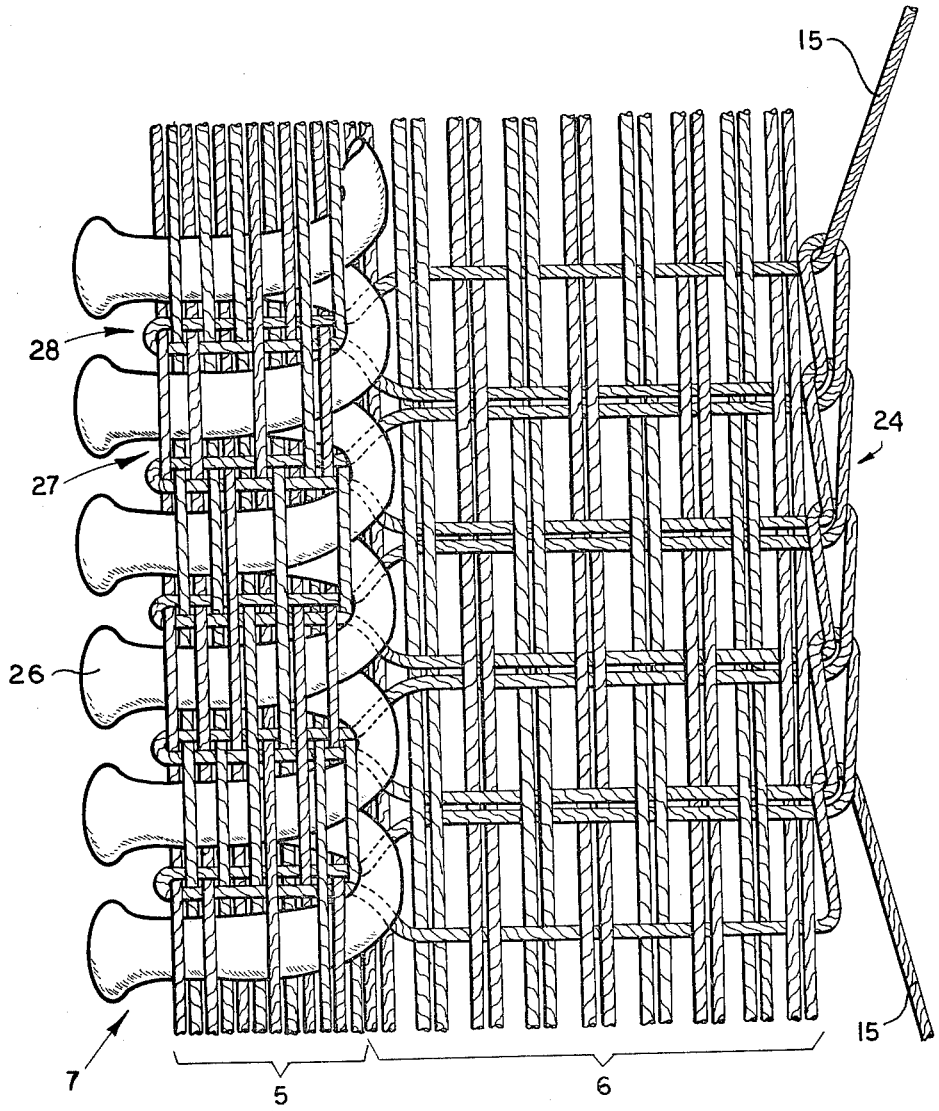
FIG. 3 is a partial plan view of one slide-fastener half of a stringer made in the loom of FIGS. 1 and 2.

The further warp shed 4 is formed from the warp yarns 6 which make up the remainder of the tape (see FIG. 3). The warp yarns 6 alternate between a low-shedded and intermediate-shedded position as seen in FIG. 1.

As can be seen from FIG. 2, the shed 3 lies, as viewed from above, midway between the two halves of the further warp shed 4. The weaving location 8 is thus at the beginning of the slide-fastener guide and can be provided with a thermal fixing unit for thermally relaxing the synthetic-resin monofilament adapted to form the coupling elements in accordance with the teachings of the applications mentioned previously.

To either side of the warp shed 3 and the further warp shed 4, there is provided a respective swingable weft-insertion device 10 which can be of conventional design except for the needle arrangement as will be discussed below.

The arm 10*a* of each of these weft-insertion devices carries a first weft-insertion needle 11 for carrying the synthetic-resin monofilament 12, adapted to form the coupling element, back and forth across the respective slide-fastener half and, naturally, across and around the mandrel 18 about which the coupling heads are formed in an interdigitated manner. The yarns 12 are fed from outside the warp arrays and are entrained by the closed thread-guide eye 13.

Each of the weft insertion devices additionally includes a weft yarn insertion needle 14 for simultaneously carrying the ground weft yarn into the shed of the respective slide-fastener half.

The ground weft yarns 15 associated with each of the slide-fastener halves is not, however, entrained by the needle 14 from an outer side of the warp array into the respective shed but rather is disposed centrally of the warp array and is picked up by the free end of the needle 14. For this purpose, the free end of the needle 14 is provided with an outwardly open notch 16 (see FIGS. 4A and 4B).

The weft-insertion needles 11 and 14 lie in superposed horizontal planes (see FIG. 2) so that the needles 11 and 14 of the two weft-insertion devices 10 can cross one another during the weaving operation.

During this operation the weft needle 11 carries the respective synthetic-resin monofilament 12 into the shed 3 above the further shed 4 while the weft needle 14 carries the respective ground weft thread 15 into the further shed 4. The ground weft thread 15 is thus passed substantially in the weaving direction at the weaving location 8 between the warp threads 5 to lock the coupling element 7 in place, the ground weft yarns 15 being guided centrally of the shed for engagement in the respective notches 16 by the guide means represented at 17.

In the weaving direction head of the weaving location 8 and behind the guide 17, there is provided centrally of the warp shed 3, the bendable mandrel 18 which is shiftable in a guide 19 engaging the end of the mandrel 18 turned away from the weaving location 8.

The mandrel holder 19, in turn, is shiftable upon a guide 20 which can be displaced by a plunger arrangement 21 between upper and lower positions. This displacement mechanism can make use of magnets or shafts or rods of the shedding arrangement, or the like, e.g., as described in the aforementioned copending applications. The guide 20 is centrally interrupted so that in the upper and lower positions of the mandrel holder 19, the monofilament 15 can be bent around the mandrel to form the respective coupling head as described in the aforementioned applications as well. To exclude undesired inward stress, the mandrel holder 19 can be flanked by a pair of width-maintaining holders 22 which prevent inward movement of the warp yarns 5.

On the outer sides of the further weft sheds 6, in the region of the weaving locations 8 adjacent the stringer guide 9, there are provided horizontally reciprocatable latch needles 23 which engage the return loop of each inlaid ground weft yarn and pass the same into a previously formed loop to form a knitted edge 24. The weft is picked up by the reed 25. Note that the weft can be laid into the warp region 6 as a double weft, i.e., the two passes of the weft can be jointly woven over and under the same warp yarns while the monofilament is likewise laid as a double weft into the warp yarns 5 while the ground weft in this region can be provided as a single weft.

The apparatus described previously and shown in the drawing is used to carry out the weaving process as follows: after shedding the warp, two weft inlaying devices 10 are swung simultaneously inwardly from opposite outer sides of the warp sheds. The synthetic-resin monofilaments 12 are carried by the eyes 13 of the respective needles 11 into the weft sheds 3. The weft needles 14 travel first empty across part of the warp and then engage, in a central region of the sheds 3, the weft thread 15 which is held in readiness by the guide 17. The respective weft threads 15 are picked up by the notches 16 of the needles 14 and are carried through the opposite half of the warp shed 3 as well as through the further warp shed 4 until the advance of the respective latch needle 23 grips the thread 15 carried past the outer edge of the warp.

The previous loop of weft, having passed over the latch, upon retraction of the latch needle closes the latch and rides over this needle while the newly formed loop of the weft is retained in the hook of the latch needle. The needle 14 than swings in the opposite direction to return the weft 15 across the warp shed. Before this return movement, the position of the mandrel holder 19 is shifted so that the return movement of the needle 11 bends the monofilament 12 around the mandrel to form the coupling head. The two coupling heads are thereby produced by opposite movements of the monofilament threads 12. The heddles control the patterns of the inlaying of the weft so that the ground weft thread 15 and the monofilament thread 12 are woven in as double wefts by the warp threads 5 and 6.

FIG. 3 shows one of the stringer halves in a partly formed state. The coupling heads or members 26 of the coupling element 7 are received in and projected from pockets 27 formed by the warp threads 5. The ground weft threads 15 form between the coupling members 26, a woven edge 28 which forms one tape edge while the other tape edge has the knitted loop arrangement 24.

FIG. 3 shows, in addition, the most advantageous pattern of weave which can be produced by appropriate operation of the heddles and shedding in the loom of FIGS. 1 and 2. The two outer and three inner warp threads 5, which lock the coupling element 7 in place are formed in a 1/1 pattern corresponding to reversing of the heddles and oppositely shedding these warp yarns during each pass of the warp. The six intervening warp threads 5 between these inner and outer warp threads 5 are reshedded after every second weft inlay and thus provide a 2/2 pattern. Finally, the knitted edge 24 can be provided by the simple interlocking loops as shown or by capturing additional threads as fillers or tie-threads therein or can be formed as a more complex knit if desired.

We claim:

1. A method of making a slide fastener string which comprises the steps of:

(a) laying a warp comprising a first set of warp threads adapted to be formed into a woven tape of one stringer half and a second set of warp threads adapted to be formed into a tape of another stringer half;

(b) shedding said warp;

(c) entraining a synthetic-resin monofilament from opposite sides of said warp into the sheds thereof and across and around a mandrel disposed between said sheds of warp threads to form respective coupling elements along confronting edges of said tape while inserting said coupling element as wefts in groups of the warp threads of each set along said edges;

(d) simultaneously with the entrainment of said monofilament into the sheds of the warp, ($d_1$) picking up a respective ground weft thread at a central region of the warp with a swinging needle, ($d_2$) entraining the picked up ground weft thread across one set of warp threads through the other set to an outer side of the warp, thereby inserting said weft thread in the shed of said other set, ($d_3$) forming a loop of the weft thread thus inserted at an outer side of said other set, ($d_4$) withdrawing the needle across both sets thereby releasing the picked up weft thread at said central region, and ($d_5$) repeating steps ($d_1$) to ($d_4$) with a needle swung across said other set with pickup of another ground weft thread and its insertion into said one set;

(e) knitting a loop of each weft thread in the respective outer side into loops of previously inserted weft;

(f) beating up the weft formed by said weft threads and synthetic-resin monofilament; and (g) repeating steps (b) to (f) to form the slide fastener stringer.

2. The method defined in claim 1 wherein said monofilament is laid as a double weft in the respective group of warp threads of the respective set.

3. The method defined in claim 1 wherein each weft thread is laid as a double weft over the remainder of the warp threads of the respective set.

4. The method defined in claim 1 wherein each said group of warp threads includes a plurality of outer warp threads, a plurality of inner warp threads, and a plurality of intermediate warp threads between said inner and outer warp threads, said inner and outer warp threads being reshedded upon each pass of the respective weft thread and said intermediate warp threads being reshedded upon at least every second pass of the respective weft thread.

5. A slide fastener stringer made by the method of claim 1 and wherein each coupling element is woven in situ as a double weft in a group of warp threads into which is woven a weft thread spanning all of the warp threads and passing between the coupling members of the coupling element to provide a woven edge in which the coupling element is locked, each stringer half having along an edge opposite the woven edge, a knitted chain of weft loops.

6. In a loom for the manufacture of a slide fastener stringer in which means is provided for shedding two sets of warp threads disposed on opposite sides of a mandrel, and weft-insertion needles carry respective synthetic-resin monofilaments from the exterior into said shed and across said mandrel to form interdigitating coupling elements which are woven into respective tapes formed at least in part by the insertion of said coupling elements as a weft into the respective sets of warp threads, the improvement which comprises:

guide means for positioning respective weft threads substantially centrally of the warp, and additional weft-insertion needles operatively connected with the first-mentioned needles and formed with means engageable with the respective weft threads upon traveling across one set of warp threads and inserting the pick-up weft threads in a shed formed by the other set of warp threads, thereby weaving a picked up weft thread into the other set of warp threads, each of said additional needles being formed with a forwardly open notch engageable with the respective weft threads and adapted to release the same.

7. The improvement defined in claim 6 wherein hook means is provided on each side of the warp for engagement with a loop of the weft threads formed upon its entrainment by the respective additional needle for locking the latter loop into previously formed loops of previously inserted weft passes.

8. The improvement defined in claim 7 wherein said hook means are each latch needles.

* * * * *